US006600889B2

(12) United States Patent
Hiroki et al.

(10) Patent No.: US 6,600,889 B2
(45) Date of Patent: Jul. 29, 2003

(54) IMAGE FORMING APPARATUS HAVING ROTATIONAL CONTROL OF SELECTIVELY ACTIVE DEVELOPMENT ROLLERS

(75) Inventors: Masashi Hiroki, Yokohama (JP); Shinji Aoki, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/953,617

(22) Filed: Sep. 17, 2001

(65) Prior Publication Data

US 2003/0053824 A1 Mar. 20, 2003

(51) Int. Cl.[7] ..... G03G 15/01
(52) U.S. Cl. ..... 399/228
(58) Field of Search ..... 399/54, 223, 228, 399/53, 226, 227

(56) References Cited

U.S. PATENT DOCUMENTS 4,801,966 A * 1/1989 Ikeda ..... 399/228
4,891,674 A * 1/1990 Seyfried ..... 399/228
4,939,547 A * 7/1990 Miyaji et al. ..... 399/228
5,132,733 A * 7/1992 Koizumi et al. ..... 399/228
5,172,168 A * 12/1992 Satoh et al. ..... 399/224
5,412,457 A * 5/1995 Kawano et al. ..... 399/228
5,440,377 A * 8/1995 Izawa et al. ..... 399/236
5,585,898 A * 12/1996 Fujii ..... 399/228

FOREIGN PATENT DOCUMENTS

JP 8-137281 5/1996

* cited by examiner

*Primary Examiner*—Robert Beatty
(74) *Attorney, Agent, or Firm*—Foley & Lardner

(57) ABSTRACT

An image forming apparatus includes a rotatable photosensitive belt which carries an electrostatic latent image, a laser exposing device which forms the electrostatic latent image on the photosensitive belt, a plurality of developing devices which selectively supply developers of different colors to the electrostatic latent image by rotation of developing rollers and develop toner images of different colors, a driving device which rotates the developing rollers, a moving device which selectively moves the developing devices between a first position in which the developing rollers contact the photosensitive belt and a second position in which the developing rollers separate therefrom, and a transfer device which superimposes and transfers the toner images onto a medium. A control device rotates a developing roller at least one revolution in the second position before the developing device, which has the developing roller, moves to the first position and develops a latent image. In addition, a developing roller of a developing device which is in the second position is rotated while a developing roller of a developing device in the first position is developing a latent image.

10 Claims, 9 Drawing Sheets

IMAGE FORMING APPARATUS HAVING ROTATIONAL CONTROL OF SELECTIVELY ACTIVE DEVELOPMENT ROLLERS

BACKGROUND OF THE INVENTION

The present invention relates to an image forming apparatus for forming a color image by electrophotography.

Some image forming apparatuses include a photosensitive belt for carrying a latent image and a plurality of developing units that are arranged opposite to the photosensitive belt to selectively supply toners of different colors (Y, M, C, K) to the belt.

In the image forming apparatuses, toner images of different colors formed on the photosensitive belt are superimposed and transferred to an intermediate transfer body to form color images. After that, the color images are transferred to recording paper at once.

In the image forming apparatuses, the developing unit for each color moves between a developing position in which its developing roller contacts the photosensitive belt and a retreating position to which the developing roller retreats from the developing position. In contact monocomponent development wherein development is performed by a developing unit filled with toner only, a toner thin film is formed on the developing roller and brought into contact with a latent image on the photosensitive belt in the developing position. After the development, the developing roller separates from the photosensitive belt and moves to the retreating position.

In the monocomponent development, a toner layer formed on the developing roller is moved to a latent image on the photosensitive belt by electrostatic force, and the latent image is developed. In this case, almost all the toner moves to the photosensitive belt from a pixel portion of the developing roller and thus the toner hardly remains on the developing roller after the development.

Toner should therefore be supplied to the developing roller to form a uniform toner layer until the developing roller makes one rotation in the developing unit and reaches a developing area again.

However, the above image forming apparatuses have the problem that an adequately thick toner layer cannot be formed continuously for an image having a high printing rate, especially an image like a belt lengthened in the sub-scanning direction and its density decreases gradually.

BRIEF SUMMARY OF THE INVENTION

The present invention has been made in consideration of the above situation and its object is to provide an image forming apparatus that is capable of continuously forming a sufficiently thick developer layer even though an image has a high printing rate or an image is shaped like a belt lengthened in the sub-scanning direction.

An image forming apparatus according to a first aspect of the present invention, comprises a rotatable image carrying body which carries an electrostatic latent image, an image forming device which forms the electrostatic latent image on the image carrying body, a plurality of developing devices which selectively supply developers of different colors to the electrostatic latent image formed by the image forming device by rotation of developing rollers and develop developer images of different colors, a driving device which rotates the developing rollers, a moving device which selectively moves the developing devices between a first position in which the developing rollers contact the image carrying body and a second position in which the developing rollers separate from the image carrying body, a transfer device which superimposes and transfers the developer images of different colors developed by the plurality of developing devices onto a medium, and a control device which rotates the developing rollers at least one revolution in the second position before one of the plurality of developing devices moves to the first position and develops a latent image.

An image forming apparatus according to a first aspect of the present invention, comprises a rotatable image carrying body which carries an electrostatic latent image, an image forming device which forms first and second electrostatic latent images on the image carrying body at regular intervals, a plurality of developing devices which selectively supply developers of different colors to the electrostatic latent images formed by the image forming device by rotation of developing rollers and develop developer images of different colors, a driving device which rotates the developing rollers, a moving device which selectively moves the developing devices between a first position in which the developing rollers contact the image carrying body and a second position in which the developing rollers separate from the image carrying body, a transfer device which superimposes and transfers the developer images of different colors developed by the plurality of developing devices onto a medium, and a control device which rotates the developing rollers when an area having no latent images between the first and second electrostatic latent images passes the developing rollers in the second position before one of the plurality of developing devices moves to the first position and develops a latent image.

An image forming apparatus according to a third aspect of the present invention, comprises a rotatable image carrying body which carries an electrostatic latent image, an image forming device which forms the electrostatic latent image on the image carrying body, a plurality of developing devices which selectively supply developers of different colors to the electrostatic latent image formed by the image forming device by rotation of developing rollers and develop developer images of different colors, a driving device which rotates the developing rollers, a moving device which selectively moves the developing devices between a first position in which the developing rollers contact the image carrying body and a second position in which the developing rollers separate from the image carrying body, a transfer device which superimposes and transfers the developer images of different colors developed by the plurality of developing devices onto a medium, and a control device which rotates the developing roller of at least one of the developing devices, which is separated from the image carrying body, simultaneously with rotation of the developing rollers of the developing devices that develop a latent image on the image carrying body.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
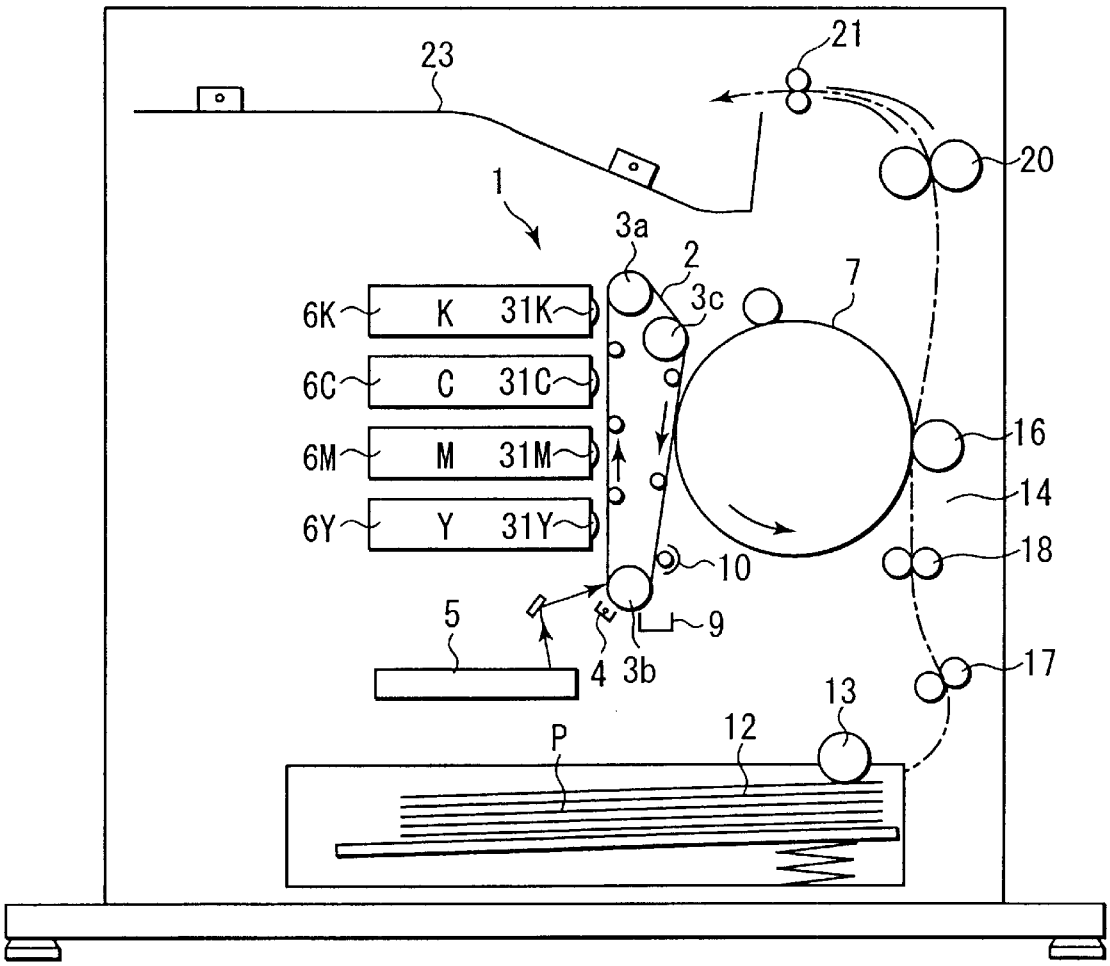
FIG. 1 is a diagram showing an internal structure of a color electrographic copying machine according to a first embodiment of the present invention.

FIG. 1 is a diagram of an internal structure of a color electrographic apparatus serving as an image forming apparatus according to an embodiment of the present invention.

The color electrographic apparatus comprises an image forming section 1. The image forming section 1 includes a photosensitive belt 2 having flexibility as an image carrying member. The photosensitive belt 2 is put between first to third rollers 3*a* to 3*c* under a given tension and runs in the direction indicated by arrows in FIG. 1.

A charging device 4 for charging the photosensitive belt 2 with a given potential in the running direction of the belt 2, a laser exposing device 5 for forming an electrostatic latent image on the charged photosensitive belt 2, and developing units 6Y to 6K for supplying the electrostatic latent image with toners of yellow (Y), magenta (M), cyan (C) and black (K) as developers and visualizing the latent image are arranged around the photosensitive belt 2.

Furthermore, an intermediate transfer drum 7 serving as a rotatable transfer device for temporarily holding a toner image formed on the photosensitive belt 2 along the running direction of the belt 2, an eliminating lamp 10, and a cleaning device 9 for removing toner remaining on the photosensitive belt 2 are arranged around the photosensitive belt 2.

A portion of the photosensitive belt 2 between the first and second rollers 3*a* and 3*b* is opposed to the developing units 6Y to 6K with a fixed clearance therebetween, and another portion thereof between the second and third rollers 3*b* and 3*c* is brought into close contact with the outer surface of the intermediate transfer drum 7.

A driving motor (not shown) is connected to any one of the first to third rollers 3*a* to 3*c*. The rotation of the driving motor allows the first to third rollers 3*a* to 3*c* to rotate at a given speed in the direction indicated by the arrows.

A paper sheet cassette 12 for holding paper sheets P as a medium of a given size is provided under the image forming section 1. The paper sheet cassette 12 includes a paper-feeding roller 13 for taking the paper sheets P out of the cassette 12 one by one. The paper sheets P taken out by the paper-feeding roller 13 are conveyed upward along a carrying path 14 that extends up and down.

The carrying path 14 includes a pair of carrying rollers 17, a pair of aligning rollers 18, a transfer roller 16 serving as a transfer device, a fixing device 20, and a pair of discharging rollers 21 in the order arranged in the carrying direction of paper sheets P.

The carrying rollers 17 carry the paper sheets P while catching them therebetween. The aligning rollers 18 stop the carried paper sheets P to correct an inclination of each of the sheets P with respect to the carrying direction and align the leading edge of each sheet P with that of the toner image formed on the intermediate transfer drum 7. The transfer roller 16 is provided opposite to the intermediate transfer drum 7 to transfer the toner image to the paper sheets P from the drum 7. The fixing device 20 fixes the transferred toner image onto the sheets P. The discharging rollers 21 discharge the paper sheets P. A discharging tray 23 for receiving the discharged sheets is provided on the discharge side of the discharging rollers 21.

A full-color printing operation of the above-described color electrophotographic apparatus will now be described.

First, the surface of the photosensitive belt 2 the back of which is grounded at 0 V is uniformly charged at −700 V by the charging device 4. Then, the laser-exposing device 5 is driven in response to a yellow image signal supplied from a controller (not shown) and a latent image of a yellow image is formed on the photosensitive belt 2. The potential of the electrostatic latent image is about −100 V.

Before the write of the yellow latent image is started, the yellow developing unit 6Y is moved toward the photosensitive belt 2, as will be described later. Concurrently with this movement, the developing roller 31Y is rotated and a voltage of −300 V is applied to the developing roller 31Y, as will be described later. When the developing roller 31Y is placed into contact with the photosensitive belt 2 by the movement of the developing unit 6Y, the latent image is developed and a yellow toner image is formed on the photosensitive belt 2.

The yellow toner image on the photosensitive belt 2 is electrostatically transferred to the intermediate transfer drum 7 to which a voltage of +1 kV is applied. The toner remaining on the photosensitive belt 2 is scraped down by a blade of the cleaning device 9. The eliminating lamp 10 eliminates the surface charge remaining on the photosensitive belt 2.

If the surface of the photosensitive belt 2 is charged again, a latent image of a magenta image is formed in the same manner as described above. This latent image is developed by the magenta developing unit 6M into a magenta toner image, and the magenta toner image is superimposed on the yellow toner image on the intermediate transfer drum 7. By repeating the same cycle for cyan (C) and black (K), toner images of four colors are superimposed into a color image on the intermediate transfer drum 7.

At this time, the paper sheet P is fed from the paper-feeding cassette 12 and carried along the carrying path 14. The paper sheet P is caught between the transfer rollers 17 and sent to the resist rollers 18. The paper sheet P is aligned by the resist rollers 18 and fed between the intermediate transfer drum 7 and the transfer roller 16. A voltage of +2 kV to +3 KV is applied to the transfer roller 16 and thus the four-color toner images are transferred from the intermediate transfer drum 7 to the paper sheet P at once. After that, the paper sheet P to which the four-color toner images are transferred is sent to the fixing device 20 of a heat roll type, in which the toner images are fused and fixed on the paper sheet P and the color image is formed thereon.

The toner remaining on the intermediate transfer drum 7 is eliminated by the cleaning device 9 using a brush to which a voltage of +1.5 kV is applied.

Figure 2:
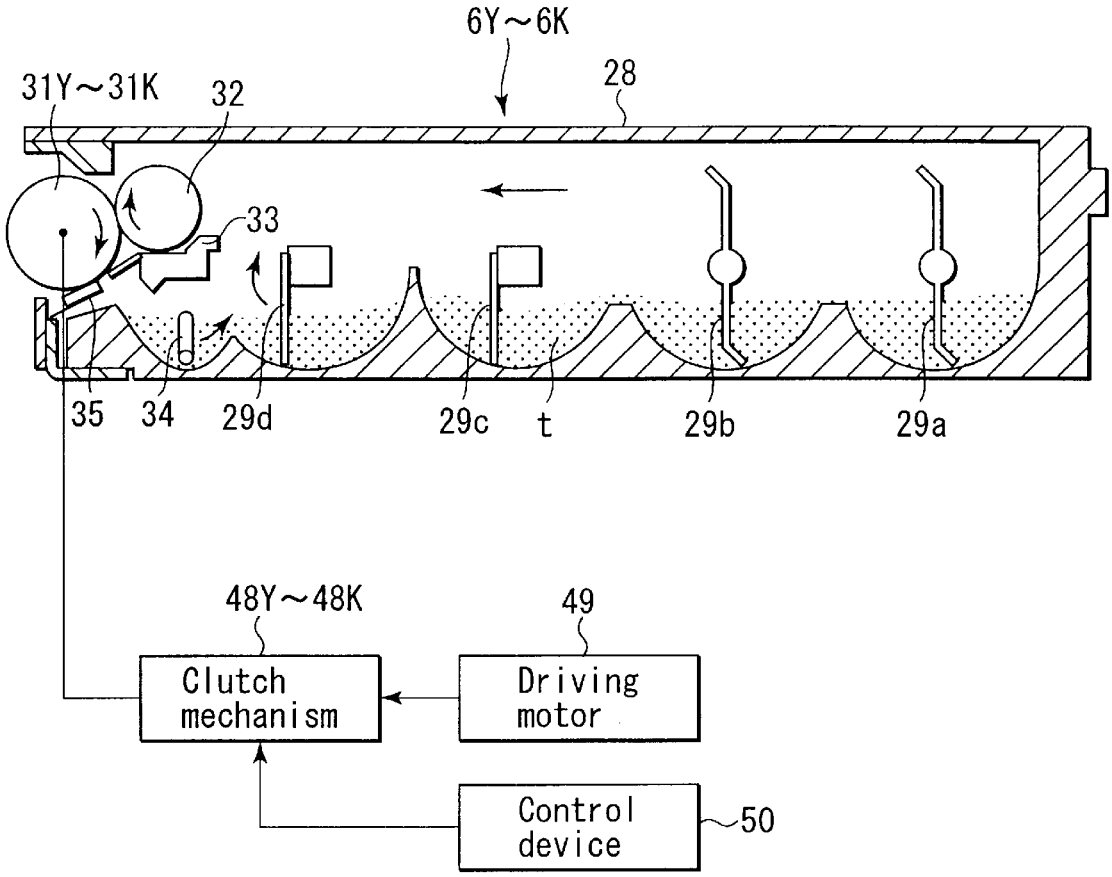
FIG. 2 is a side-sectional view of a developing unit and a drive control system.

FIG. 2 is a cross-sectional view of the developing unit 6Y (6M, 6C, 6K).

In FIG. 2, reference numeral 28 denotes a developing casing that is filled with a predetermined amount of toner t as a developer. A plurality of carrying vanes 29*a* to 29*d* for carrying the toner t in the direction of the arrow are arranged at regular intervals in the developing casing 28.

The developing roller 31Y (31M, 31C, 31K) is rotatably provided in the front portion of the developing casing 28 and opposed to the photosensitive belt 2. An intermediate roller 32 is provided behind and in contact with the developing roller 31Y (31M, 31C, 31K). A toner guide 33 is provided under the intermediate roller 32. A collecting paddle 34 for collecting surplus toner is provided under the toner guide 33. A charging blade 35 is brought into contact with the lower portion of the developing roller 31Y (31M, 31C, 31K) by an appropriate pressure.

The developing rollers 31Y to 31K are connected to a single driving motor 49 through a power transmission system and clutch mechanisms 48Y to 48K, which will be described later. A control device 50 is connected to the clutch mechanisms 48Y to 48K via a control circuit to control the operations of the clutch mechanisms 48Y to 48K. This control allows the driving force of the single driving motor 49 to be selectively transmitted to the developing rollers 31Y to 31K; accordingly, the developing rollers 31Y to 31K are selectively rotated.

During the development, the carrying vanes 29*a* to 29*d* are rotated and the toner t is carried. The toner t is raised up to the intermediate roller 32 and the entrance of the toner guide 33 by the carrying vane 29*d* closest to the developing roller 31Y (31M, 31C, 31K). The raised toner t is carried between the developing roller 31Y (31M, 31C, 31K) and the charging blade 35 by the intermediate roller 32. The toner t that passes between the developing roller 31Y (31M, 31C, 31K) and the charging blade 35 receives a given amount of charge and serves as a toner layer having a uniform thickness. The toner layer contacts a latent image on the photosensitive belt 2, and the latent image is developed. The surplus toner, which did not pass between the developing roller 31Y (31M, 31C, 31K) and the charging blade 35, is returned to the carrying vane 29*d* at the final stage by the collecting paddle 34. The intermediate roller 32 rotates in the direction opposite to the rotational direction of the developing roller 31Y (31M, 31C, 31K) and accordingly the remaining toner is scraped from the developing roller 31Y (31M, 31C, 31K).

Figure 3:
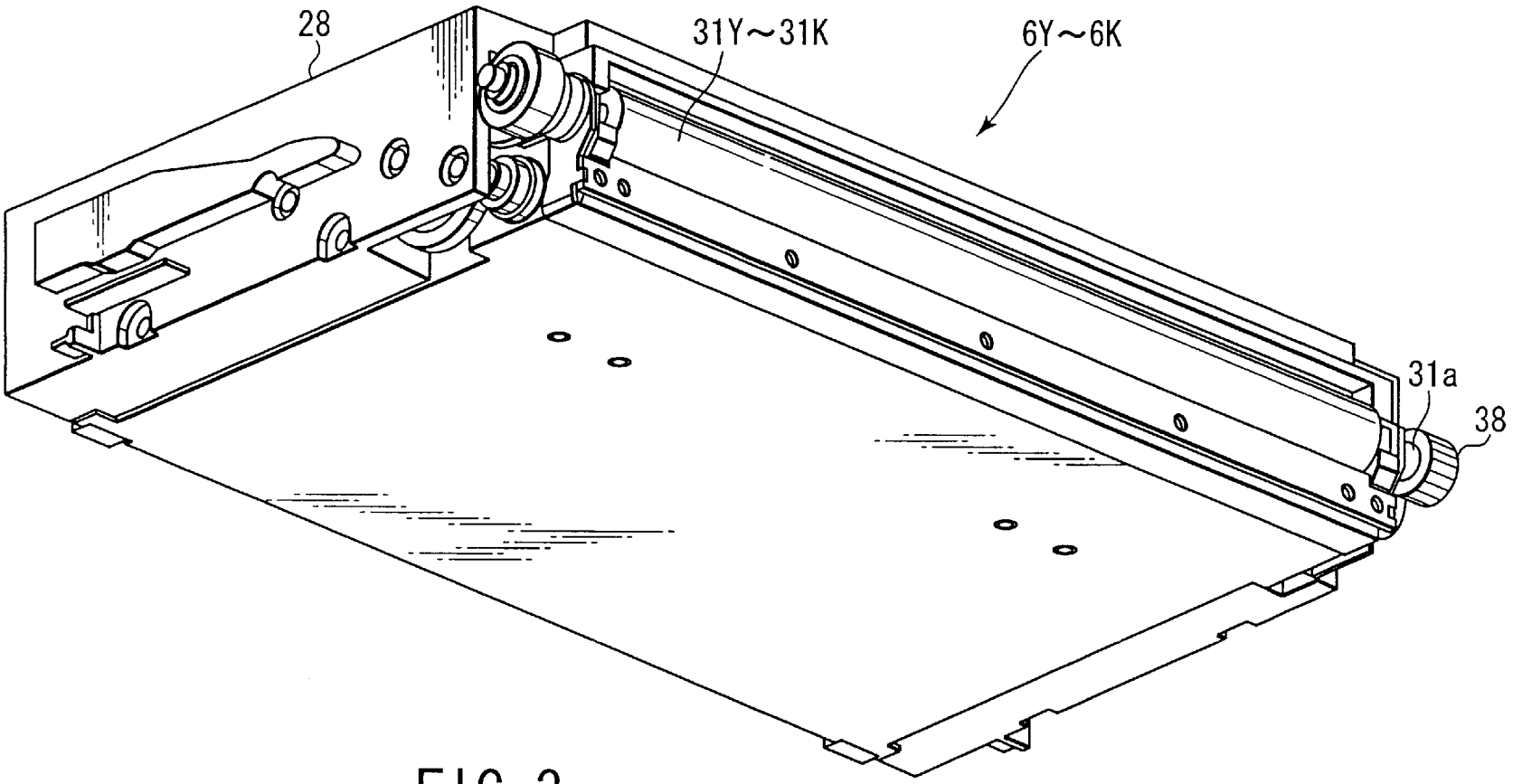
FIG. 3 is a perspective view of the developing unit.

FIG. 3 is a perspective view showing an outward appearance of the developing unit 6Y (6M, 6C, 6K).

A shaft 31*a* of the developing roller 31Y (31M, 31C, 31K) protrudes outside the developing casing 28, and a gear 38 is fixed to a projected portion of the shaft. The gear 38 is rotated by a driving system, which will be described later. Thus, the developing roller 31Y (31M, 31C, 31K) is rotated.

Figure 4:
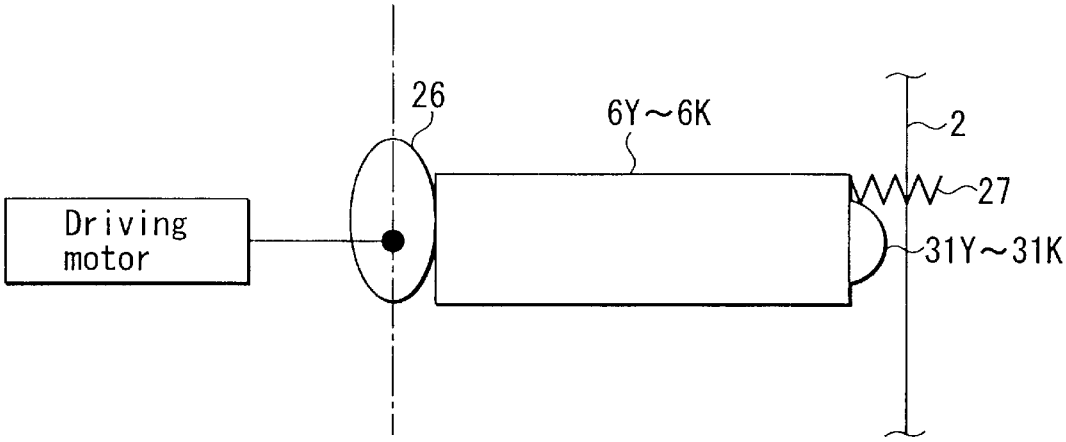
FIG. 4 is a diagram of a developing roller of the developing unit, which is separated from a photosensitive belt.
Figure 5:
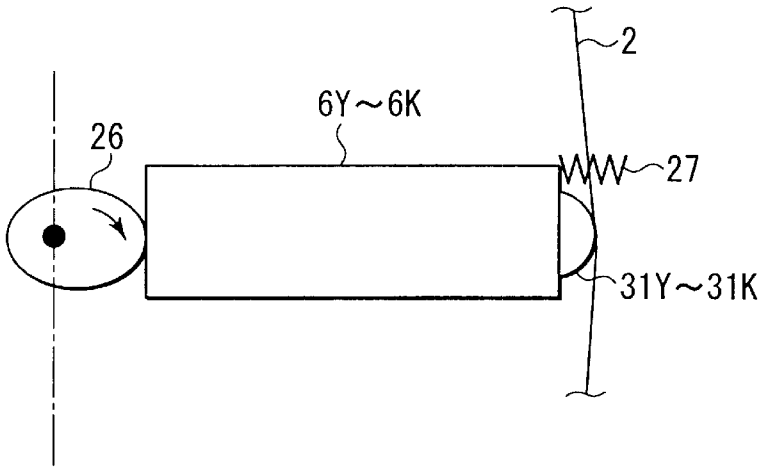
FIG. 5 is a diagram of a developing roller of the developing unit, which contacts the photosensitive belt.

FIGS. 4 and 5 illustrate a moving device for moving the developing unit 6Y (6M, 6C, 6K) to the photosensitive belt 2.

The developing unit 6Y (6M, 6C, 6K) is provided movably in which directions it contacts and separates from the photosensitive drum 2. An eccentric cam 26 is connected to the back of the developing unit 6Y (6M, 6C, 6K) and rotated by a driving system (not shown). A spring member 27 is connected to the front portion of the developing unit 6Y (6M, 6C, 6K) and energizes the unit 6Y (6M, 6C, 6K) in which direction it separates from the photosensitive belt 2.

Before the development, as shown in FIG. 4, the eccentric cam 26 stands up, and the developing unit 6Y (6M, 6C, 6K) is moved back by the energizing force of the spring member 27 and the developing roller 31Y (31M, 31C, 31K) is separated from the photosensitive belt 2.

At the start of the development, as shown in FIG. 5, the eccentric cam 26 is rotated 90° in a clockwise direction by the driving system (not shown). Thus, the developing unit 6Y (6M, 6C, 6K) is moved toward the photosensitive belt 2 against the energizing force of the spring member 27 to bring the developing roller 31Y (31M, 31C, 31K) into contact with the photosensitive belt 2.

After the development, as shown in FIG. 4, the eccentric cam 26 rotates and stands up, and the developing unit 6Y (6M, 6C, 6K) is moved back by the energizing force of the spring member 27 and the developing roller (31M, 31C, 31K) is separated from the photosensitive belt 2.

Figure 6:
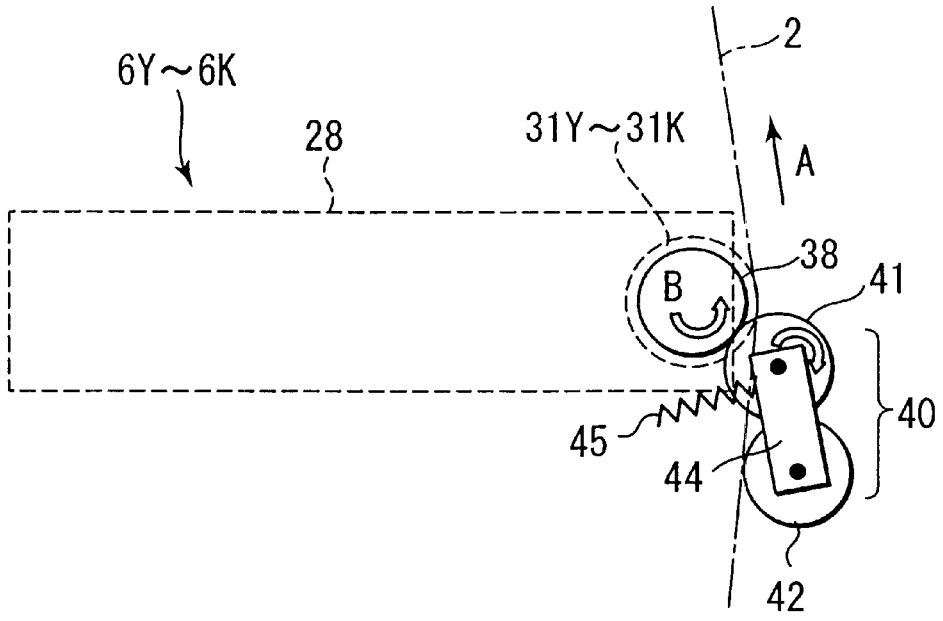
FIG. 6 is a diagram showing a position of a drive gear when the developing roller contacts the photosensitive belt.
Figure 7:
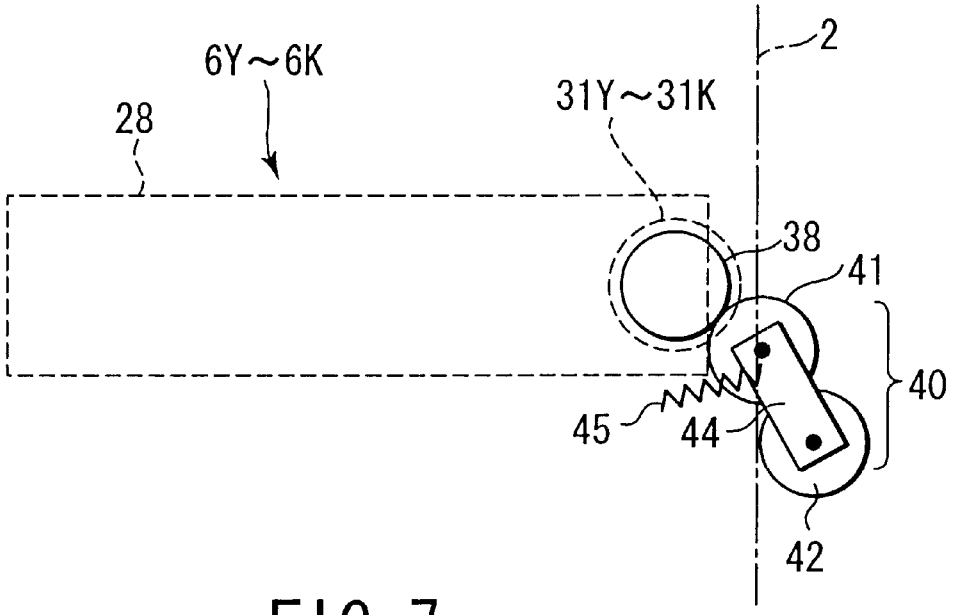
FIG. 7 is a diagram showing a position of the drive gear when the developing roller is separated from the photosensitive belt.

FIGS. 6 and 7 illustrate a driving system 40 of the developing unit 6Y (6M, 6C, 6K).

The driving system 40 includes a final-stage gear 41 engaged with a gear 38 of the developing roller 31Y (31M, 31C, 31K). As the final-stage gear 41 rotates, the developing roller 31Y (31M, 31C, 31K) of the developing unit 6Y (6M, 6C, 6K) is rotated and so are the intermediate roller 32 and the carrying vanes 29*a* to 29*d*. A relay gear 42 is engaged with the final-stage gear 41, and a driving motor 49 is connected to the relay gear 42 through a gear (not shown) and the clutch mechanism 48Y (48M, 48C, 48K).

The same driving system rotates the developing rollers 31Y to 31K, intermediate roller 32, and carrying vanes 29*a* to 29*d* of the developing units 6Y to 6K of four colors. The driving motor 49, which is common to the developing units 6Y to 6K of four colors, connects and disconnects their clutch mechanisms 48Y to 48K so as to selectively drive the developing units 6Y to 6K.

The final-stage gear 41 is rotatably attached to the upper end of an arm 44. The lower end of the arm 44 is rotatably supported by the central axis of the relay gear 42. The arm 44 is energized in an anticlockwise direction by a spring 45, and the final-stage gear 41 is pressed against the gear 38 of the developing unit 6Y (6M, 6C, 6K) by the energizing force.

During the development, as has been described in FIG. 5, the rotation of the eccentric cam 26 moves the developing unit 6Y (6M, 6C, 6K) toward the photosensitive belt 2 and its developing roller 31Y (31M, 31C, 31K) contacts the photosensitive belt 2. At this time, as illustrated in FIG. 6, the developing roller 31Y (31M, 31C, 31K) rotates in the direction of arrow B and the photosensitive belt 2 runs in the direction of arrow A.

After the development, when the eccentric cam 26 rotates and stands up as shown in FIG. 4, the developing unit is returned by the energizing force of the spring member 27 and, as shown in FIG. 7, the developing roller 31Y (31M, 31C, 31K) separates from the photosensitive belt 2 and stands by. Then, the arm 44 is rotated by the energizing force of the spring 45, and the gear 38 of the developing unit 6Y (6M, 6C, 6K) and the final-stage gear 41 of the driving system 40 remain engaged with each other.

Figure 8:
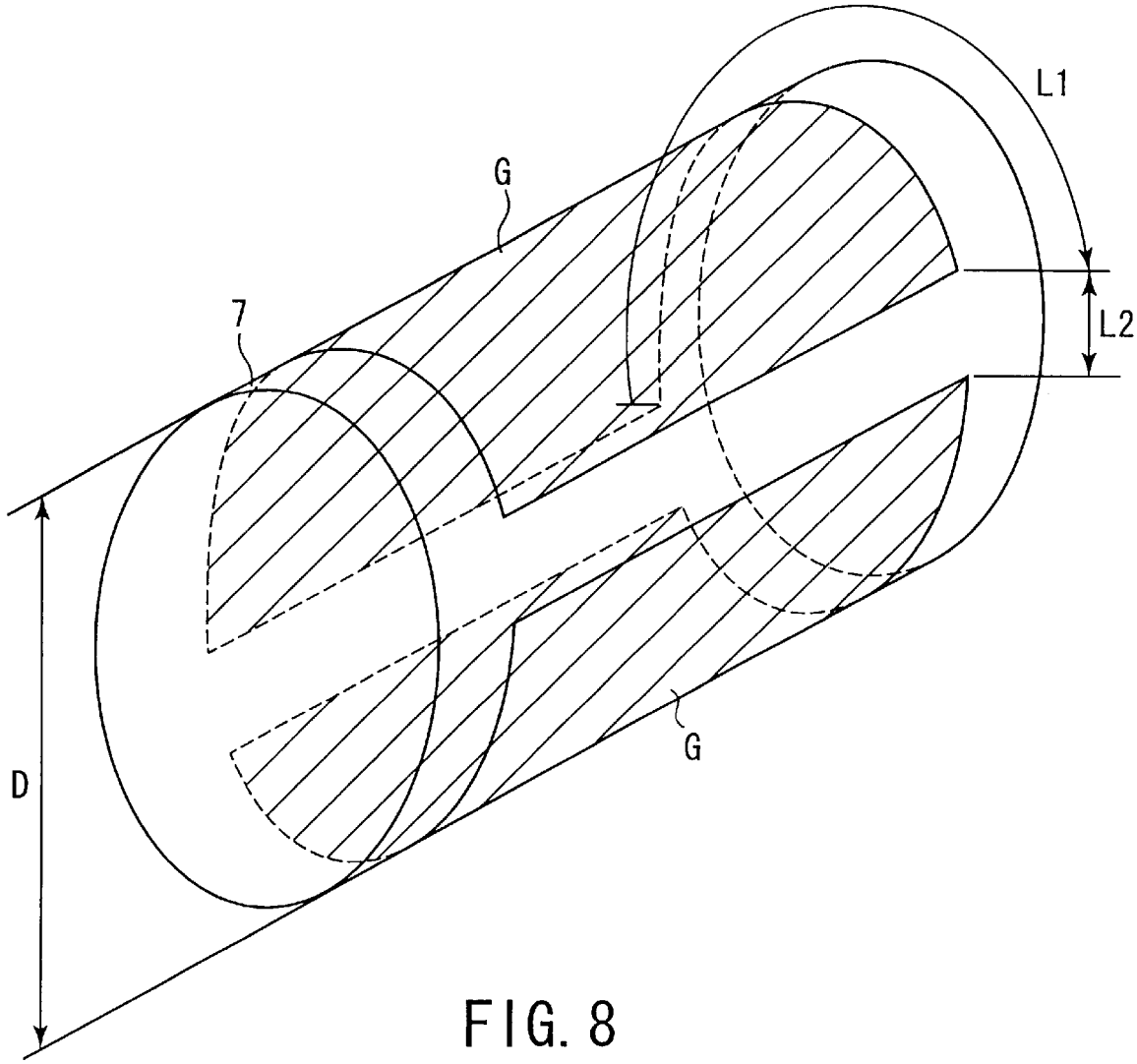
FIG. 8 is a perspective view of an intermediate transfer drum, which shows a toner image forming area.

FIG. 8 is a diagram of the arrangement of color images formed on the intermediate transfer drum 7.

The diameter D of the intermediate transfer drum 7 on which a color image is formed by superimposing toner images of different colors developed on the photosensitive belt 2 is set such that two toner images G corresponding to a letter-size paper sheet (having a length L1 in its sub-scanning direction) can be formed at once and an interval (L2) for carrying paper sheets P can be obtained between the toner images G and G. It is thus possible to print two color images by four rotations of the intermediate transfer drum 7.

If the width of the letter-size paper sheet is 216 mm and the paper sheet carrying interval is 51 mm, the diameter D of the intermediate transfer drum 7 is $2\times(216+51)\div\pi\approx170$ mm. If the carrying interval is shortened, the intermediate transfer drum 7 can be decreased in size; however, a high degree of accuracy is required for carrying the paper sheets P. If the carrying interval is lengthened instead, the paper sheets P can easily be carried but the apparatus is increased in size. The above values or those close thereto are therefore adequate.

The carrying interval of paper sheets P is influenced by the printing speed. If the process speed is 180 mm/sec, a time interval t between paper sheets is $51\div180\approx283$ msec. Even though the paper sheets are carried irregularly due to a slip and a misalignment between paper sheets when they are set in the paper cassette, a process for clearing a paper jam and aligning the leading edges of paper sheets can be performed.

FIGS. 9 to 12 are diagrams each showing the timing at which the developing units 6Y and 6M (6C, 6K) are selectively connected to and separated from the photosensitive belt 2 when a color image is printed continuously.

The developing units 6Y to 6K are arranged vertically, and a distance between the developing rollers 31Y to 31K is set to 54 mm. The distance depends upon the amount of toner with which the developing units 6Y to 6K are filled and the shape of the apparatus. The developing units 6Y to 6K are arranged from below so as to correspond to yellow (Y), magenta (M), cyan (C), and black (K) in the order designated.

As has been described in FIG. 8, when the paper sheets are of a letter size (or A4 size), printing is performed two by two. The development is therefore performed in the following order: a first latent image of yellow (Y), a second latent image of yellow (Y), a first latent image of magenta (M), a second latent image of magenta (M), a first latent image of cyan (C), a second latent image of cyan (C), a first latent image of black (K), and a second latent image of black (K). Between the first and second latent images, the developing unit 6Y (6M, 6C, 6K) is neither connected to nor separated from the photosensitive belt, but the developing roller 31Y (31M, 31C, 31K) always contacts the photosensitive belt 2.

Figures 9, 10, 11, 12:
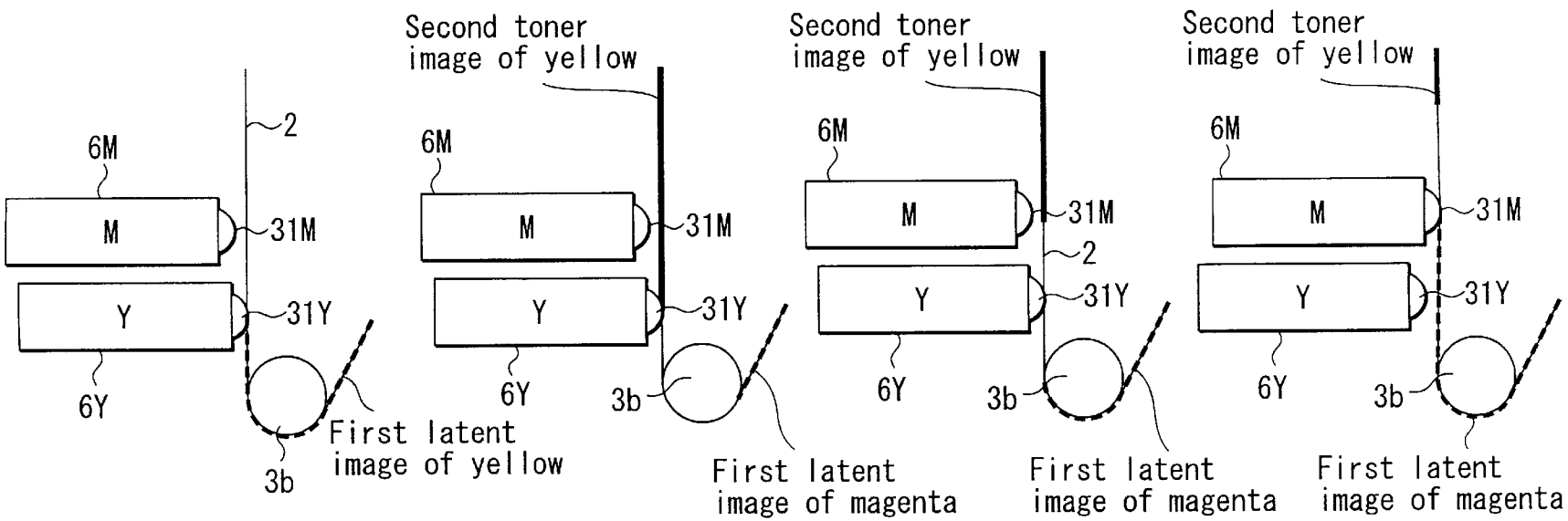
FIG. 9 is a diagram of a development state of a yellow latent image.
FIG. 10 is a diagram of a development end state of the yellow latent image.
FIG. 11 is a diagram of a developing roller of a magenta developing unit, which runs at idle.
FIG. 12 is a diagram of a development state of a magenta latent image.

FIG. 9 shows a state in which the developing unit 6Y starts to develop a first latent image of yellow (Y) on the photosensitive belt 2. FIG. 10 shows a state in which the development of a second latent image of yellow (Y) is completed.

FIG. 11 shows a state in which a second toner image of yellow (Y) passes through the magenta developing unit 6M. FIG. 12 illustrates a state in which the leading edge of a first latent image of magenta (M) reaches the developing roller 31M of the magenta developing unit 6M.

Considering the magenta developing unit 6M only, it is moved from a standby position to a development position to rotate the developing roller 31M from the state of FIG. 11 in which the trailing edge of a second toner image of yellow (Y) passes the magenta developing unit until when the first latent image of magenta (M) reaches the developing roller, i.e., within interval L2 between paper sheets P in terms of time or within 283 msec in terms of time.

Actually, the developing unit has to contact the photosensitive belt with sufficient time before the latent image reaches the developing roller. The above operation should be completed within 200 ms or shorter.

If the developing roller 31M starts to rotate at the same time when the developing unit 6M starts to move within the above time, the developing roller 31M makes $0.84(=(240\times0.2)/(18\times\pi))$ rotations until the developing unit starts its development since the diameter of the developing roller 31M is 18 mm and the peripheral speed thereof is 240 mm/sec.

As has been described in the Background of the Invention, the contact monocomponent development has the problem that if a solid image is printed continuously in the sub-scanning direction, its density decreases gradually. This is because all the toner t on the developing roller 31Y (31M, 31C, 31K) is moved to the photosensitive belt 2 and the developing roller is short of toner though the intermediate roller 32 supplies it.

Though the paper sheets are of a letter size (the length of which is about 216 mm in the sub-scanning direction), the density of 1.4 at the leading edge of an image is decreased to 1.3 at the trailing edge thereof. Such a decrease does not cause image quality to lower so greatly. However, when the developing unit 6Y (6M, 6C, 6K) develops the image on the second and third paper sheets and then retreats and contacts the photosensitive belt 2 again to develop the image, a difference in density becomes wide between the images on the second and third sheets if the image has a high printing rate.

To prevent the above problem, the peripheral speed of the developing rollers 31Y to 31K is sometimes made higher than that of the photosensitive belt 2. If the peripheral speed of the developing rollers 31Y to 31K is doubled or more, the image density can be maintained at 1.4. In the high-speed development performed at a process speed of 180 mm/sec (a carrying speed of the photosensitive belt), however, the peripheral speed of the developing rollers 31Y to 31K is 360 mm/sec or higher and their surface temperature becomes 60° C. or higher by their friction against the charging blade 35. Thus, the toner is softened and adhered to the developing rollers 31Y to 31K, resulting in great degradation of image quality.

Controlling the pressure of the charging blade 35 can thicken the toner layer. In this case, however, the toner will fly and leak from the developing rollers 6Y to 6K.

In the present invention, when the developing roller 31Y (31M, 31C, 31K) of the developing unit 6Y (6M, 6C, 6K) is separated from the photosensitive belt 2, it is rotated at least one revolution through the clutch mechanism 48Y (48M, 48C, 48K) from the driving motor 49, as described in FIGS. 6 and 7. Thus, a state in which all the toner is moved from the developing roller 31Y (31M, 31C, 31K) by a developing operation can be returned to a state in which an adequately thick toner layer is formed all over the developing roller 31Y (31M, 31C, 31K).

Consequently, whatever the number of developments, a developing operation can be started from this state. Though the density slightly decreases from the leading edge of one image toward the trailing edge thereof, the density of the leading edge is not low. A good image can thus be obtained.

As has been described in FIGS. 9 to 12, when a paper sheet carrying interval is short, time for causing the developing roller 31Y (31M, 31C, 31K) to make one rotation cannot be taken only by the contact operation of the developing roller before the development. In the present invention, however, when the developing roller 31Y (31M, 31C, 31K) is separated from the photosensitive belt 2, an adequate time to rotate the developing roller 31Y (31M, 31C, 31K) can be taken, which is effective in a small-sized apparatus in which an interval between paper sheets is short.

A second embodiment of the present invention will now be described.

First, when the power of the apparatus is turned on, the apparatus is warmed up to cause the temperature of the fixing device 20 to reach a temperature enough to fuse and fix the toner. In the meantime, the developing rollers 31Y to 31K of developing units 6Y to 6K of different colors are rotated to form an adequately thick toner layer all over the developing rollers 31Y to 31K.

In the continuous printing operation, the development is performed for yellow (Y), magenta (M), cyan (C), and black (K) in the order designated. During a time period between the odd-numbered and even-numbered yellow (Y) developments when an area having no toner images passes the developing unit 6M (hereinafter referred to as passage time), the developing roller 31M of the developing unit 6M is rotated to form an adequately thick toner layer on the developing roller 31M.

If the carrying interval between paper sheets P is short, the developing roller 31Y (31M, 31C, 31K) cannot be rotated one revolution within the above passage time. If, however, the developing roller 31Y (31M, 31C, 31K) is rotated even in the contact operation before the development, it can be done one or more revolution.

The developing roller 31M of the developing unit 6M is rotated at the timing of the above passage time, for the following reason.

When the developing roller 31M is rotated, it is likely to move and contact the photosensitive belt 2 to distort a yellow (Y) toner image. However, when the developing roller 31M is rotated at the timing of the above passage time, it contacts an area of the photosensitive belt 2 having no toner image; therefore, the yellow toner image is not distorted.

As in the above operation, the developing roller 31C of the developing unit 6C is rotated during a time period between the odd-numbered and even-numbered magenta (M) developments when an area with no toner image passes the developing unit 6C, the developing roller 31K of the developing unit 6K is rotated during a time period between the odd-numbered and even-numbered cyan (M) developments when an area with no toner image passes the developing unit 6K, and the developing roller 31Y of the developing unit 6Y is rotated during a time period between the odd-numbered and even-numbered black (K) developments when an area with no toner image passes the developing unit 6Y. Consequently, the same advantage can be obtained from all the developing units 6Y to 6K.

Figure 13:
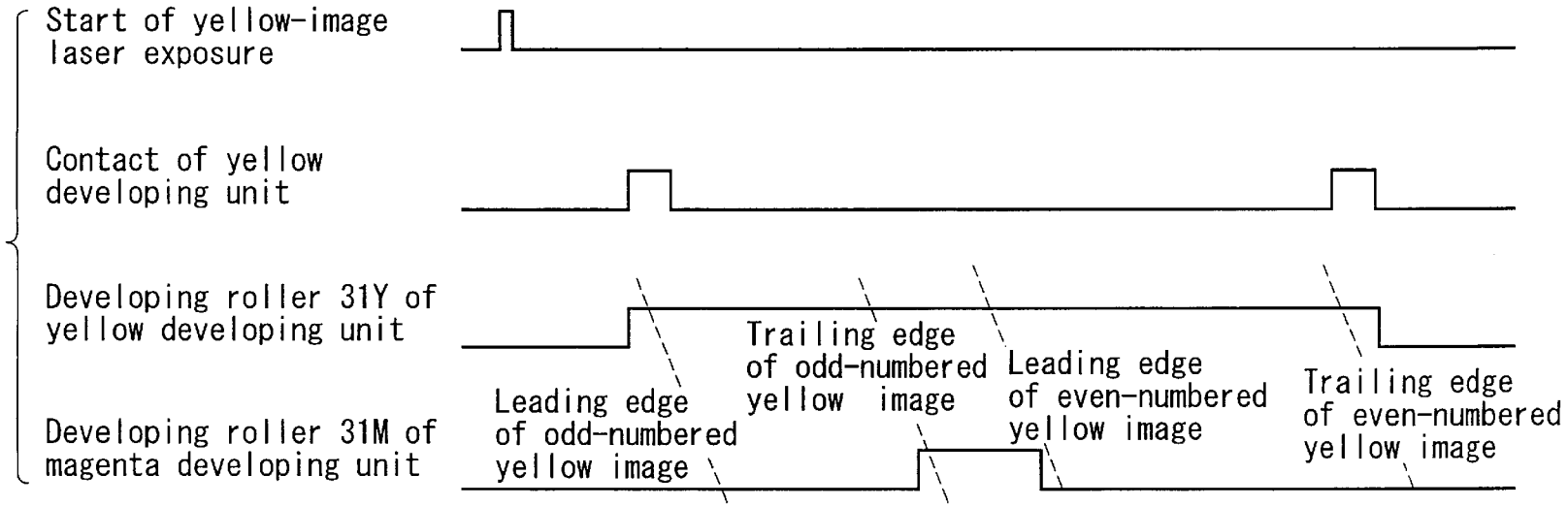
FIG. 13 is a flowchart showing a development operation according to a second embodiment of the present invention.

FIG. 13 is a timing chart showing a developing operation according to the second embodiment described above.

When yellow-image laser exposure is started, a cam driving motor is driven to rotate the cam 26 corresponding to the developing unit 6Y. Thus, the developing roller 31Y of the developing unit 6Y contacts the photosensitive belt 2. The driving motor 49 of the developing roller 31Y is also driven at the same time when the cam driving motor is driven. After the developing roller 31Y contacts the photosensitive belt 2 and its rotational speed reaches a desired one, the leading edge of a latent image of the odd-numbered yellow image passes a developing position to perform a developing operation.

After the trailing edge of a latent image of the odd-numbered yellow image passes the developing position, the cam driving motor is driven again and the cam 26 retreat, with the result that the developing roller 31Y of the developing unit 6Y separates from the photosensitive belt 2 and stops. Then, the developing roller 31M of the developing unit 6M is driven from when the trailing edge of the odd-numbered yellow toner image passes the developing position of the developing unit 6M until when the leading edge of the even-numbered yellow toner image passes it.

A third embodiment of the present invention will now be described.

First, when the power of the apparatus is turned on, the apparatus is warmed up to cause the temperature of the fixing device 20 to reach a temperature enough to fuse and fix the toner. In the meantime, the developing rollers 31Y to 31K of developing units 6Y to 6K of different colors are rotated to form an adequately thick toner layer all over the developing rollers 31Y to 31K.

In the continuous printing operation, the development is performed for yellow (Y), magenta (M), cyan (C), and black (K) in the order designated. The developing roller 31M of the developing unit 6M is rotated one ore more revolution at the same time when the development of yellow (Y) starts. This rotation can continue until the development is completed. This is to prevent the following problem. Since one developing roller 31Y (31M, 31C, 31K) is rotated and stopped through the clutch mechanism 48Y (48M, 48C, 48K) by the single driving motor 49, if another developing roller is rotated during the development, a load is suddenly applied to the driving motor 49, and the developing roller 31Y (31M, 31C, 31K) is varied in rotational speed and vibrated. If the developing rollers 31Y to 31K are varied in speed and vibrated, density variations occur in the sub-scanning direction of an image and stripes appear, resulting in degradation of image quality.

According to the third embodiment, since the developing roller 31M of the magenta developing unit 6M is rotated one or more revolution at the same time when development is performed for yellow (Y), an excessive load is not applied to the driving motor 49 during the development; therefore, a uniform image can be formed.

If the developing roller 31C of cyan (C) is rotated at the same time when development is performed for magenta (M), the developing roller 31K of black (K) is rotated at the same time when development is performed for cyan (C), and the developing roller 31Y of yellow (Y) is rotated at the same time when development is performed for black (K) as in the above, the same advantage can be obtained from all the developing units 6Y to 6K.

Figure 14:
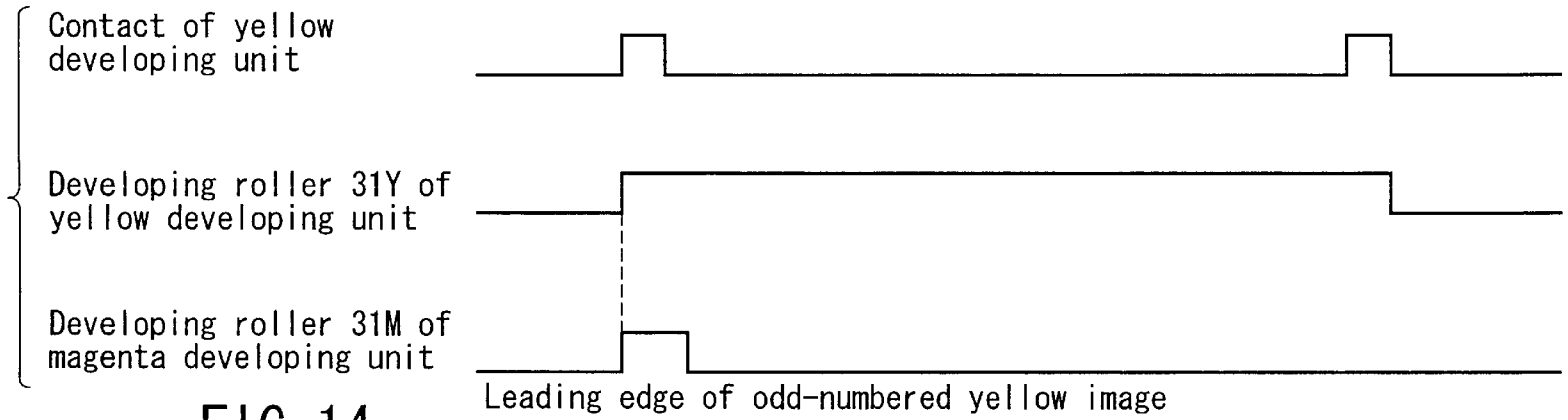
FIG. 14 is a flowchart showing a development operation according to a third embodiment of the present invention.

FIG. 14 is a timing chart showing a developing operation according to the third embodiment described above.

The developing operation of a yellow (Y) latent image is the same as that in the second embodiment described with reference to FIG. 13. In the third embodiment, the developing roller 31M of the magenta developing unit 6M is driven and idled at the same time when the developing roller 31Y of the yellow developing unit 6Y starts to be driven.

Figure 15:
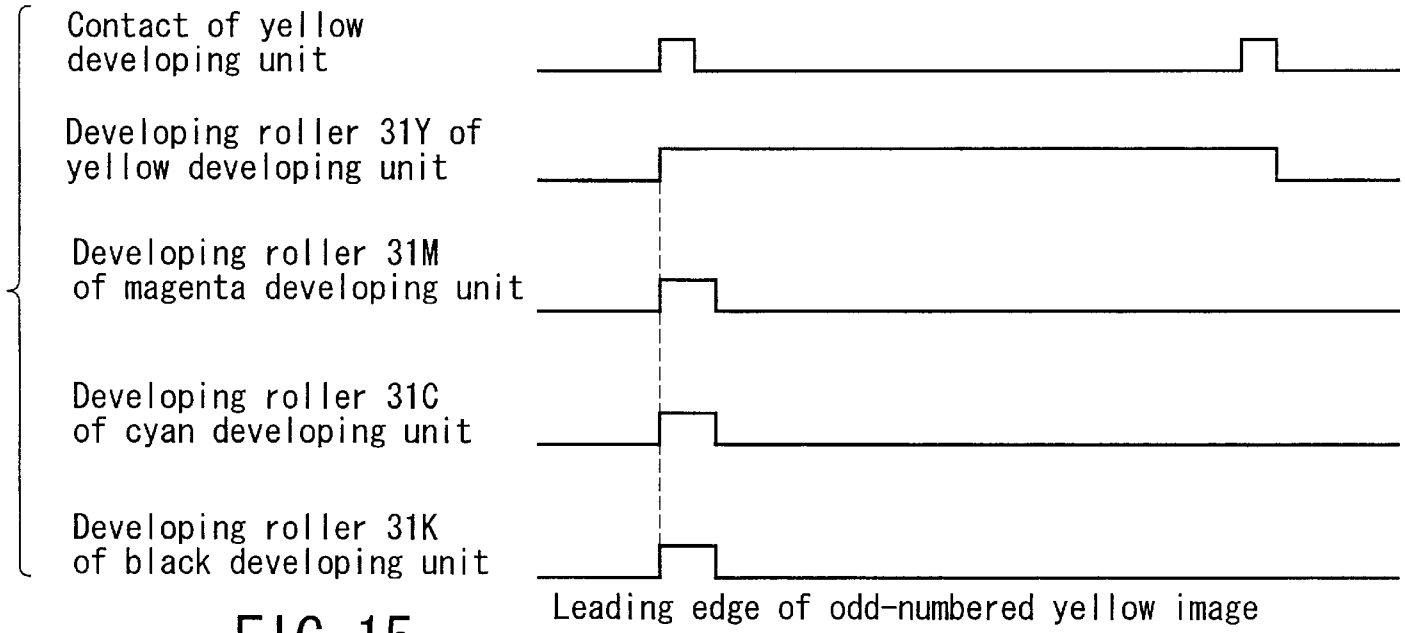
FIG. 15 is a flowchart showing a development operation according to a fourth embodiment of the present invention.

As shown in FIG. 15, all the developing rollers 31M to 31K of magenta, cyan, and black developing units 6M to 6K can be driven and idled at the same time when the developing roller 31Y of the yellow developing unit 6Y starts to be driven.

Figure 16:
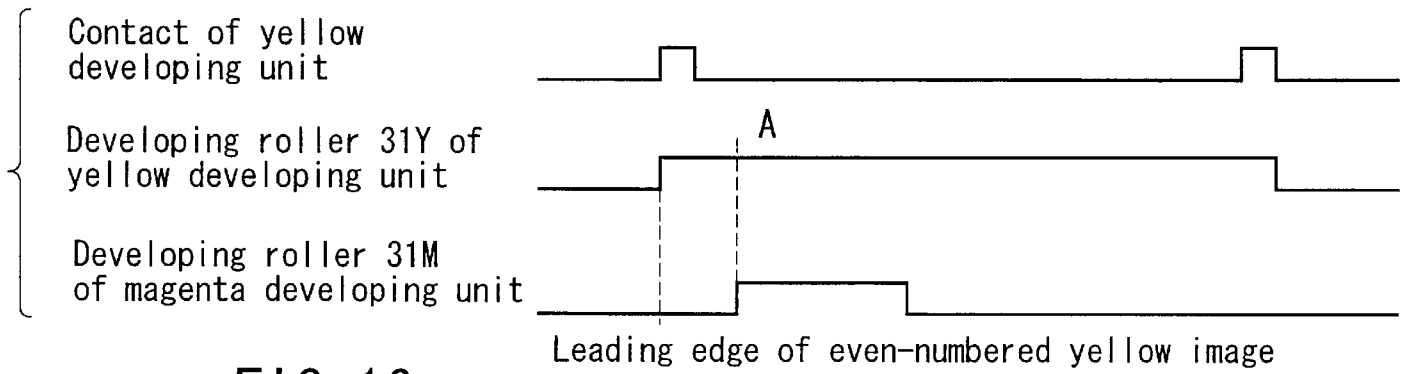
FIG. 16 is a chart showing a rotation operation of the developing roller of the magenta developing unit while a yellow developing unit is performing a development operation.

FIG. 16 shows an example in which the developing roller 31M of the magenta developing unit 6M is driven and idled while the yellow developing unit 6Y is performing its developing operation.

In this example, the developing roller 31Y is vibrated at time A when the developing roller 31M of the magenta developing unit 6M starts to rotate and thus a yellow image is distorted (density variations in the sub-scanning direction and displacement in position from another color).

Additional advantages and modifications will readily occur to those skilled in the art. Therefore, the invention in its broader aspects is not limited to the specific details and representative embodiments shown and described herein. Accordingly various modifications may be made without departing from the spirit or scope of the general inventive concept as defined by the appended claims and their equivalents.

What is claimed is:

1. An image forming apparatus comprising:

a rotatable image carrying body which carries an electrostatic latent image;

an image forming device configured to form the electrostatic latent image on the image carrying body;

a plurality of developing devices which selectively supply developers of different colors to the electrostatic latent image formed by the image forming device by rotation of developing rollers and develop the electrostatic latent image to form developers images of different colors;

a driving device which rotates the developing rollers;

a moving device which selectively moves the developing devices between a first position in which the developing rollers contact the image carrying body and a second position in which the developing rollers separate from the image carrying body;

a transfer device which superimposes and transfers the developer images of different colors developed by the plurality of developing devices onto a medium; and a control device which rotates a developing roller at least one revolution in the second position before one of the plurality of developing devices which has the developing roller moves to the first position and develops a latent image.

2. The image forming apparatus according to claim 1, wherein the image carrying body is a photosensitive belt.

3. The image forming apparatus according to claim 1, wherein the plurality of developing devices selectively supply toners of yellow, magenta, cyan and black.

4. The image forming apparatus according to claim 1, wherein the transfer device includes an intermediate transfer drum that rotates, the developer images of different colors being superimposed on the intermediate transfer drum and transferred to the medium at once.

5. The image forming apparatus according to claim 4, wherein the intermediate transfer drum has a circumference that allows two developer images corresponding to a medium of a given size to be formed simultaneously at regular intervals in a rotational direction.

6. The image forming apparatus according to claim 1, wherein the driving device includes a single driving source, the single driving source is connected to the developing rollers of the plurality of developing devices through a clutch mechanism, and the control device selective connects the clutch mechanism to selectively rotate the developing rollers.

7. The image forming apparatus according to claim 1, wherein the moving device includes an eccentric cam which moves the developing devices toward the image carrying body and an energizing member which energizes the developing devices in a direction in which the developing devices separate from the image carrying body.

8. The image forming apparatus according to claim 1, wherein a ratio of a rotational speed of the developing rollers to a rotational speed of the image carrying body is 2 or lower.

9. An image forming apparatus comprising:

a rotatable image carrying body which carries an electrostatic latent image;

an image forming device which forms first and second electrostatic latent images on the image carrying body at regular intervals;

a plurality of developing devices which selectively supply developers of different colors to the electrostatic latent images formed by the image forming device by rotation of developing rollers and develop the electrostatic latent image to form developer images of different colors;

a driving device which rotates the developing rollers;

a moving device which selectively moves the developing devices between a first position in which the developing rollers contact the image carrying body and a second position in which the developing rollers separate from the image carrying body;

a transfer device which superimposes and transfers the developer images of different colors developed by the plurality of developing devices onto a medium; and a control device which rotates a developing roller of a developing device when an area having no latent images between the first and second electrostatic latent images passes the developing roller in the second position before one of the other of the plurality of developing devices moves to the first position and develops a latent image.

10. An image forming apparatus comprising:

a rotatable image carrying body which carries an electrostatic latent image;

an image forming device which forms the electrostatic latent image on the image carrying body;

a plurality of developing devices which selectively supply developers of different colors to the electrostatic latent image formed by the image forming device by rotation of developing rollers and develop the electrostatic latent image to form developer images of different colors;

a driving device which rotates the developing rollers;

a moving device which selectively moves the developing devices between a first position in which the developing rollers contact the image carrying body and second position in which the developing rollers separate from the image carrying body;

a transfer device which superimposes and transfers the developer images of different colors developed by the plurality of developing devices onto a medium; and a control device which rotates a developing roller of at least one of the developing devices, which is separated from the image carrying body, simultaneously with rotation of a developing roller of a developing device that develops a latent image on the image carrying body, wherein the driving device includes a single driving source, the single driving source is connected to the developing rollers of the plurality of developing devices through a clutch mechanism, and the control device selectively connects the clutch mechanism to selectively rotate the developing rollers.

* * * * *